US008127671B2

(12) United States Patent
Schmitt

(10) Patent No.: US 8,127,671 B2
(45) Date of Patent: Mar. 6, 2012

(54) PRINTING UNIT OF A PRINTING MACHINE, AND METHOD FOR USING A PRINTING UNIT

(75) Inventor: Christoph Alfons Schmitt, Dittelbrunn/Hambach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/737,722

(22) PCT Filed: Jul. 23, 2009

(86) PCT No.: PCT/EP2009/059457

§ 371 (c)(1),
(2), (4) Date: Feb. 10, 2011

(87) PCT Pub. No.: WO2010/018050

PCT Pub. Date: Feb. 18, 2010

(65) Prior Publication Data

US 2011/0126728 A1 Jun. 2, 2011

(30) Foreign Application Priority Data

Aug. 13, 2008 (DE) ..... 10 2008 041 238

(51) Int. Cl.
*B41F 5/16* (2006.01)

(52) U.S. Cl. ..... 101/182; 101/218

(58) Field of Classification Search ..... 101/182, 101/218

See application file for complete search history.

(56) References Cited

U.S. PATENT DOCUMENTS

| | | | | | |
|---|---|---|---|---|---|
| 4,069,959 | A * | 1/1978 | Bartell et al. | ..... | 226/21 |
| 4,697,515 | A * | 10/1987 | Germann | ..... | 101/179 |
| RE34,483 | E * | 12/1993 | Bowman et al. | ..... | 101/138 |
| 5,383,393 | A * | 1/1995 | Ueda et al. | ..... | 101/220 |
| 5,617,788 | A * | 4/1997 | Horiguchi et al. | ..... | 101/181 |
| 5,782,182 | A | 7/1998 | Ruckmann et al. | | |
| 5,809,882 | A * | 9/1998 | Ruckmann et al. | ..... | 101/177 |
| 6,789,476 | B2 * | 9/2004 | Langsch | ..... | 101/228 |
| 7,707,936 | B2 | 5/2010 | Schneider et al. | | |
| 2003/0005836 | A1 * | 1/2003 | Knauer | ..... | 101/220 |

FOREIGN PATENT DOCUMENTS

| | | | |
|---|---|---|---|
| DE | 44 08 025 | A1 | 9/1995 |
| DE | 195 48 819 | A1 | 7/1997 |
| DE | 10 2004 009 861 | A1 | 9/2005 |
| EP | 1 498 264 | A2 | 1/2005 |
| WO | 2005037553 | A1 | 4/2005 |

* cited by examiner

*Primary Examiner* — Anthony Nguyen
(74) *Attorney, Agent, or Firm* — Mattingly & Malur, P.C.

(57) ABSTRACT

A printing unit of a printing machine is configured having at least two frame parts, a spacing between which can be modified. Several form cylinders and several transfer cylinders, which cooperate to print a web, are located on each of the at least two frame parts. The distance between the two frame parts is less when the printing unit is closed than it is when the printing unit is open. The printing unit includes at least two web guiding elements. A first tangent is established by a transfer cylinder of a stationary one of the frame parts. A second tangent is established by the at least two web guiding elements. The first tangent and the second tangent are spaced from each other at a distance.

18 Claims, 5 Drawing Sheets

PRINTING UNIT OF A PRINTING MACHINE, AND METHOD FOR USING A PRINTING UNIT

CROSS-REFERENCES TO RELATED APPLICATIONS

This application is the U.S. national phase, under 35 U.S.C. 371, of PCT/EP2009/059457, filed Jul. 23, 2009; published as WO 2010/018050 on Feb. 18, 2010, and claiming priority to DE 10 2008 041 238.4, filed Aug. 13, 2008, the disclosures of which are expressly incorporated herein by reference.

FIELD OF THE INVENTION

The invention relates to a printing unit of a printing press and a method for using a printing unit. The printing unit has at least two frame elements, the relative distance between which can be modified. The printing unit guides a material web to be printed. The printing unit has at least two web guiding elements.

BACKGROUND OF THE INVENTION

From WO 2005/037553 A1 a printing unit of a printing press is known, wherein the printing unit is embodied as a printing tower and wherein at least two frame parts are provided, the relative distance between which can be modified. One of the frame parts is embodied as stationary and the other of the frame parts is embodied as movable. The movable frame part can be moved to a position in which it is spaced from the stationary frame part, creating an intermediate space between the frame parts and therefore also between the blanket cylinders of the two frame parts, wherein a press operator can enter the intermediate space and perform maintenance operations such as replacing the blanket. When the printing unit is in this opened position, the imprinted paper web, or the paper web to be imprinted, rests against the blanket cylinders of the stationary frame part. Once the maintenance operation is completed, the movable frame part is moved back up to the stationary frame part.

From DE 195 48 819 A1 a printing unit is known, which is embodied as a printing tower. One of the printing couples of said printing unit can be in print operation while another printing couple of the printing unit is in the print-off position. In the print-off position, a print-off gap is formed between the blanket cylinders. The printing unit has a plurality of displacement devices, one or more of which are placed against the paper web so as to allow the paper web to pass through the printing couple that is in the print-off position without coming into contact with the blanket cylinders. The displacement devices are embodied as ink-repellent paper guiding rollers that can be moved back and forth.

From DE 10 2004 009 861 A1 a method and a device for operating printing units is known. The printing units have movable web guiding elements with which the paper web can be guided through the print-off gap between two blanket cylinders of a printing couple that is in the print-off position, without coming into contact with said cylinders. These web guiding elements can be positioned in the infeed area and/or in the outfeed area of a printing couple. If one web guiding element is arranged in the infeed area and another web guiding element is arranged in the outfeed area of the printing couple, at least the web guiding element located in the outfeed area is embodied as movable. The movable web guiding element is positioned by means of drives, wherein the drives are preferably remotely actuated via a control device. The drives can be embodied as pressure-actuated cylinders or as electric motors.

DE 44 08 025 A1 discloses a printing unit with two frame parts, the distance between which can be modified. Guiding rollers are provided for guiding the web.

SUMMARY OF THE INVENTION

The problem addressed by the invention is that of providing a printing unit of a printing press and a method for using a printing unit.

The problem is solved according to the invention by the provision of two frame parts of the printing unit, the relative distance between which can be modified. When the printing unit is closed, a material web to be printed rests against transfer cylinders supported in both frame parts. When the printing unit is open, the material web is spaced from both of the transfer cylinders. The printing unit has at least two web guiding elements.

The benefits to be achieved by the invention consist particularly in that the material web, preferably the paper web, is moved away from the transfer cylinder or cylinders by the at least one web guiding element, either automatically as the printing unit is being opened or in response to input by a user. As a result of this separation, when maintenance work, for example washing the transfer cylinder(s) or blanket cylinder (s), is being performed with a paper web that has already been fed in, the web does not rest against the at least one transfer cylinder or blanket cylinder. Damage, such as a softening of the paper web caused by one or more washed transfer cylinders, for example, can thereby be prevented.

BRIEF DESCRIPTION OF THE DRAWINGS

Embodiment examples of the invention are illustrated in the set of drawings and will be specified in greater detail in what follows.

The drawings show.

DESCRIPTION OF THE PREFERRED EMBODIMENT

Figure 2:
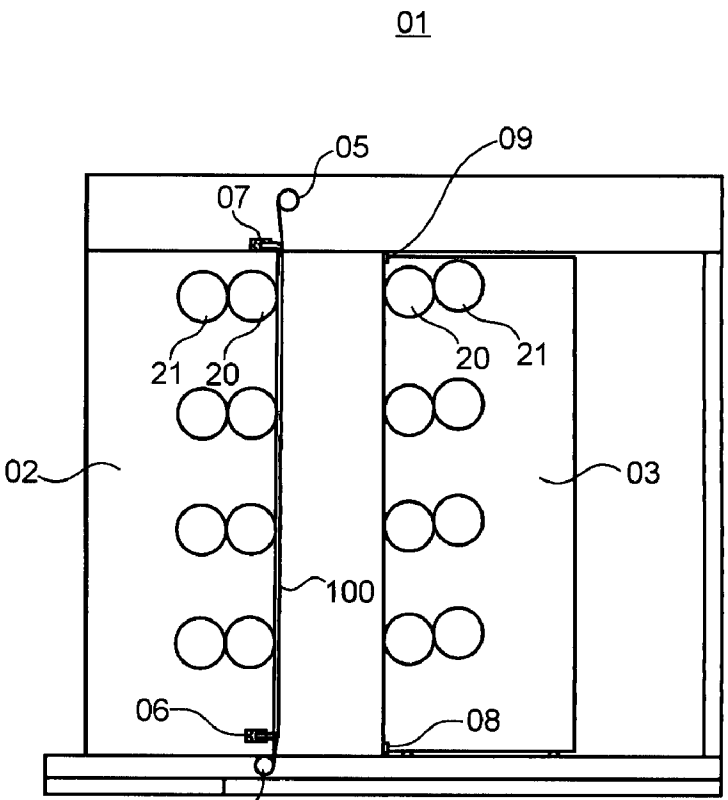
FIG. 2 a schematic illustration of the printing unit of FIG. 1 with the printing unit in the open position.
Figure 1:
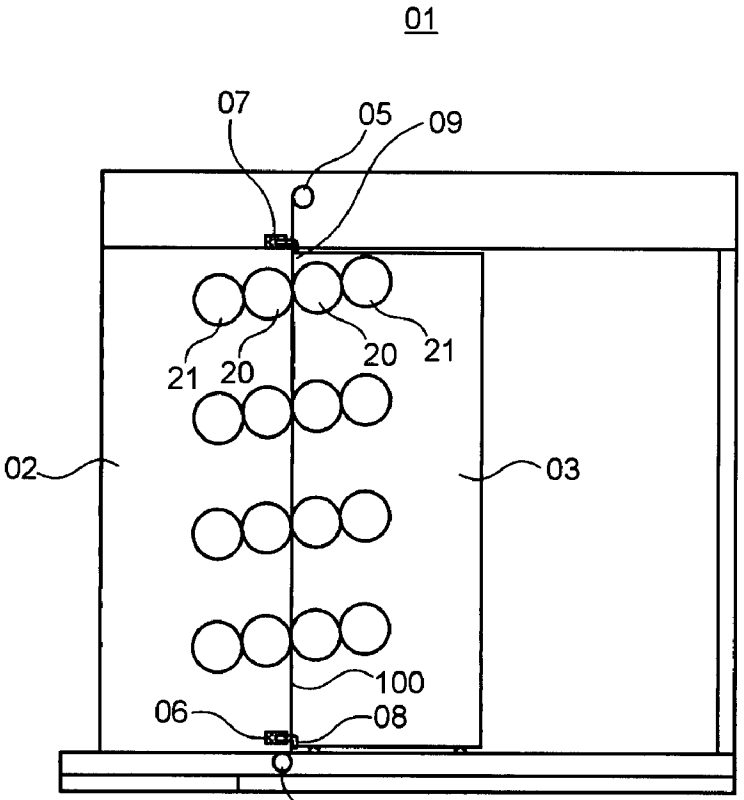
FIG. 1 a schematic illustration of a printing unit comprising one stationary frame part and one movable frame part, with the printing unit in the closed position.

A printing unit 01 is shown in FIGS. 1 and 2. This printing unit 01 is embodied as a printing tower, through which a material web 100, preferably a paper web 100, passes, traveling from bottom to top.

The printing unit 01 is comprised of a plurality of printing couples arranged one above the other, wherein the embodiment example illustrated here comprises eight printing couples, with every two printing couples forming a blanket-to-blanket printing couple, in this case four blanket-to-blanket printing couples. Of course, the invention is not limited to this number of printing couples. Each of the printing couples has a transfer cylinder 20 or blanket cylinder 20, which interacts in a known manner with a forme cylinder 21 or plate cylinder 21. The printing couples further comprise inking and dampening units, not shown here, which are held, together with the blanket cylinders 20 and the plate cylinders 21, between two side frame plates of the frame parts 02; 03. In the interest of clarity, in FIGS. 1 and 2 the transfer cylinder 20 or blanket cylinder 20 and the form cylinder 21 or plate cylinder 21 of only the uppermost printing couple are labeled with reference signs.

The precise configuration of the printing couples will not be specified in detail here, as it is not essential to an understanding of the present invention. For information on the inner structure of a printing couple and on its functioning, reference is made to EP 14 98 264 A2, the subject matter of which is hereby made the subject matter of the present invention in this respect.

Of the frame parts 02; 03, frame part 02 is embodied as stationary and frame part 03 is embodied as movable. In the position shown in FIG. 1, the movable frame part 03 is moved up against the stationary frame part 02.

When the frame parts 02; 03 are in this position, the printing unit 01 is in its closed position, for imprinting the paper web 100.

FIG. 2 shows the movable frame part 03 in a position in which it is spaced from the stationary frame part 02. When the frame parts 02; 03 are in this position, maintenance operations, for example, such as washing the blanket cylinders 20, replacing a blanket, etc., can be performed in the area between the frame parts 02; 03.

Reference sign 04 identifies web guiding element 04, particularly a lower, infeed-side guiding roller 04, and reference sign 05 identifies another web guiding element 05, particularly an upper, outfeed-side guiding roller 05, for guiding the paper web 100 in the infeed area and in the outfeed area of the printing unit 01. Both guiding rollers 04; 05 are embodied as stationary.

Figure 6:
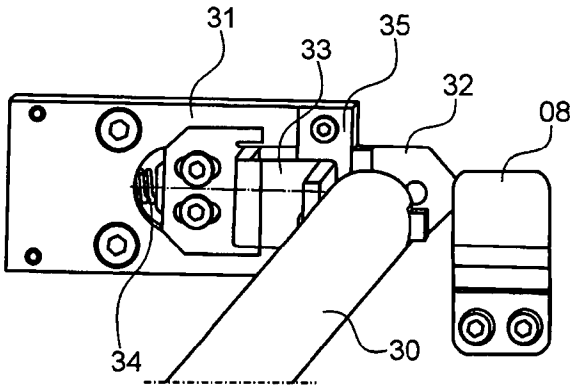
FIG. 6 a perspective illustration of a mounting device according to FIG. 5 with an end section of the web guiding element arranged on the mounting device.
Figure 5:
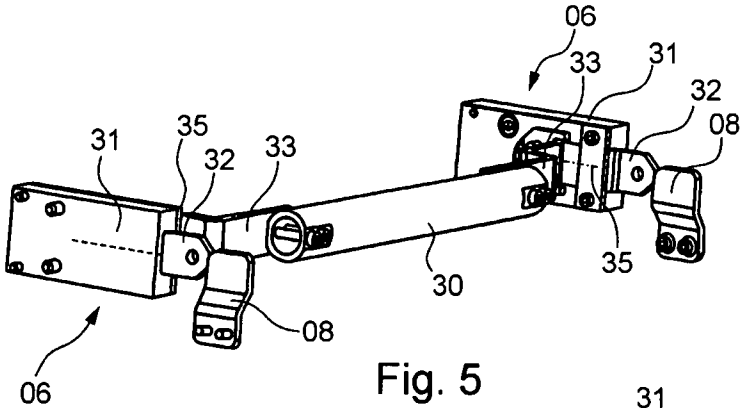
FIG. 5 a perspective illustration of a web guiding element, movably disposed on two mounting devices.
Figure 7:
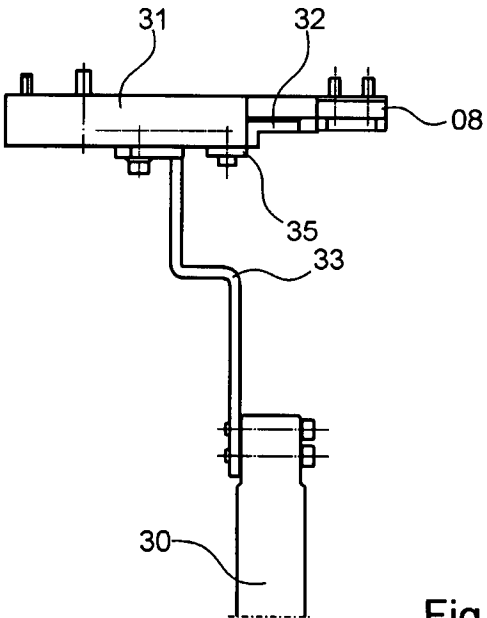
FIG. 7 a plan view of the mounting device according to FIG. 6 with the end section of the web guiding element arranged on the mounting device.

Reference signs 06 and 07 identify mounting devices 06; 07 for the web guiding elements 30, illustrated in greater detail in FIGS. 5 to 7. The mounting devices 06; 07 are arranged in pairs at the infeed side and the outfeed side of the stationary frame part 02 of the printing unit 01. One web guiding element 30 is arranged between a pair of lower mounting devices 06 and another web guiding element is arranged between a pair of upper mounting devices 07, as is illustrated in FIG. 5.

Reference signs 08; 09 identify actuating elements 08; 09, which are disposed on the movable frame part 03. The actuating elements 08; 09 are arranged in pairs on the infeed side and on the outfeed side of the movable frame part 03 of the printing unit 01, wherein reference sign 08 identifies the lower actuating element(s) 08 and reference sign 09 identifies the upper actuating element(s) 09.

Each of the frame parts 02; 03 has two side frame plates spaced from one another, wherein on each of the side frame plates of the stationary frame part 02, one mounting device 06 is arranged on the infeed side and one mounting device 07 is arranged on the outfeed side. In addition, on each of the side frame plates of the movable frame part 03, one actuating element 08 is disposed on the infeed side and one actuating element 09 is disposed on the outfeed side. Of course, it is also possible to provide only one web guiding element 30, or more than two web guiding elements 30 per printing unit 01, rather than two web guiding elements 30 per printing unit 01. What is essential is that the at least one web guiding element 30 must be capable of lifting the paper web 100 a certain prescribed distance off of the transfer cylinder or cylinders 20, so that the paper web 100 will not become softened or its quality impaired in some other way by the washing of the transfer cylinders 20 or by the washed transfer cylinders 20.

Figure 3:
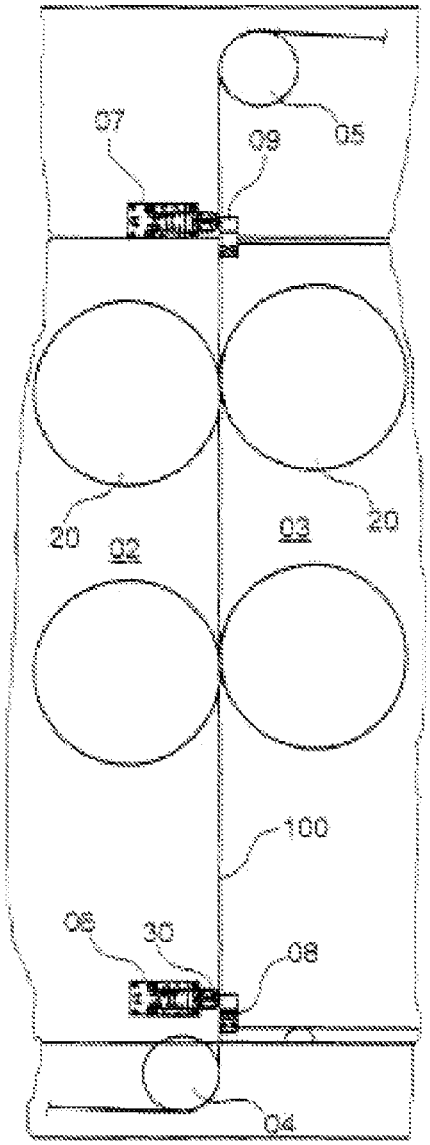
FIG. 3 a schematic illustration of the path of the paper web through a printing unit when the printing unit is in the closed position.
Figure 4:
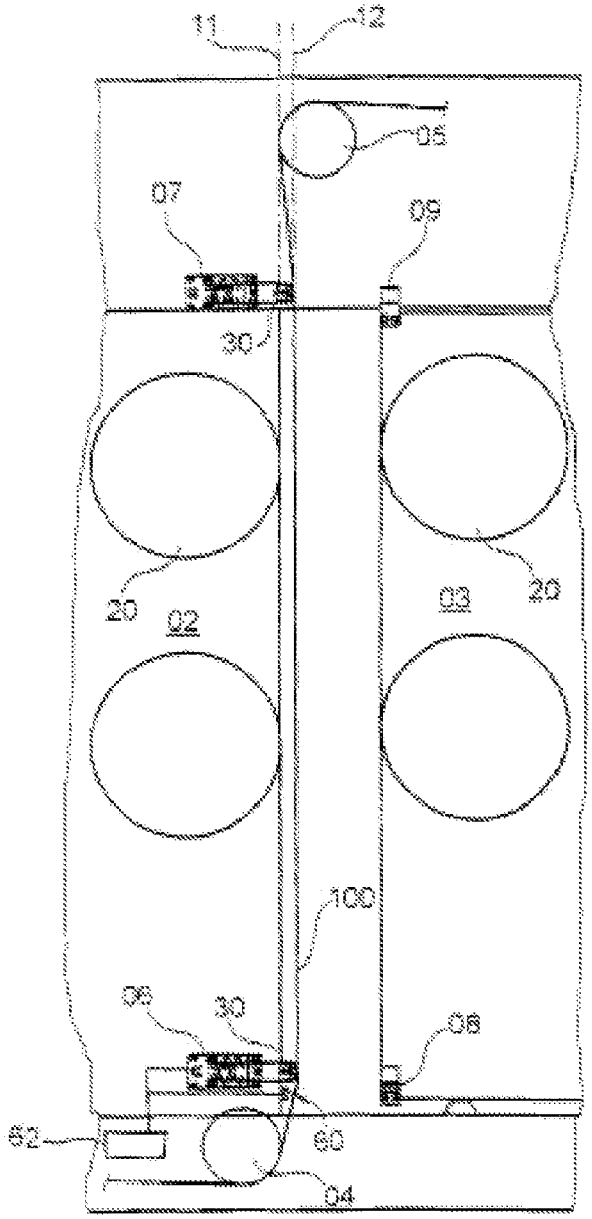
FIG. 4 a schematic illustration of the path of the paper web through the printing unit of FIG. 3 when the printing unit is in the open position.

FIG. 3 shows the path of the paper web 100 through the printing unit 01 when the printing unit 01 is closed. FIG. 4 shows the path of the paper web 100 through the printing unit 01 when the printing unit 01 is open.

The printing unit 01 according to FIGS. 3 and 4 comprises two printing couples arranged one above the other, wherein in the interest of clarity, only the transfer cylinders 20 or the blanket cylinders 20 of the upper printing couple are labeled with reference signs in FIGS. 3 and 4. With regard to the remaining configuration of the printing couples, reference is made to the above statements relating to FIGS. 1 and 2.

When the printing unit 01 is closed in accordance with FIG. 3, the paper web 100 travels on the infeed side over the lower guiding roller 04, then through the printing gap between the two pairs of blanket cylinders 20, by which it is imprinted, and then exits the printing unit 01 on the outfeed side via guiding roller 05.

When the movable frame part 03 is moved toward the right from the position shown in FIG. 3 to the position shown in FIG. 4, the paper web 100 is lifted not only off of the blanket cylinders 20 of the movable frame part 03, but also off of the blanket cylinders 20 of the stationary frame part 02. The latter is achieved in that, when the printing unit is opened to the position shown in FIG. 4, the web guiding element 30, which is illustrated in greater detail in FIGS. 5 to 7, is automatically shifted from a first position shown in FIG. 3 to a second position shown in FIG. 4. This change in position of the web guiding element 30 causes the paper web 100 to be lifted off of the blanket cylinders 20 of the stationary frame unit 02, or increases the distance between the paper web 100 and the blanket cylinders 20 of the stationary frame unit 02. This separation can extend, for example, over a distance of at least 5 mm, preferably at least 8 mm, and particularly preferably at least 10 mm, wherein this value is intended purely as an example, and does not serve to limit the invention.

This lifting of the paper web 100, or this increase in the distance of the paper web 100 from the blanket cylinder or cylinders 20, can be carried out automatically or in a self-actuated manner when the printing unit 01 is opened, starting from the position shown in FIG. 3. As an alternative thereto, it is conceivable for the paper web 100 to be lifted off of the blanket cylinder or cylinders 20, or its distance therefrom increased, by means of the at least one web guiding element 30 not automatically, but only when an operator of the printing unit 01 or a maintenance staff member actuates an operating element.

In the position shown in FIG. 4, the paper web 100 is spaced far enough from the blanket cylinders 20 of the stationary frame part 02 that said cylinders can be washed without negatively affecting the paper web 100. In particular, because of the distance or the increase in spacing, the paper web 100 does not rest against the blanket cylinders 20, and therefore also cannot become softened by the washed blanket cylinders 20.

When the printing unit 01 is closed from the position shown in FIG. 4 to the position shown in FIG. 3, the web guiding elements 30 are automatically returned to the first position shown in FIG. 3. This is achieved by means of the actuating elements 08; 09, which are disposed on the movable frame part 03.

FIG. 5 shows a perspective view of the web guiding element 30, which is movably arranged on two mounting devices 06; 07, which are in turn stationarily arranged on two side frame walls of the stationary frame part 02. The web guiding element 30 consists, for example, of a pipe 30 or a rod 30, the length of which is equal to or greater than the width of the paper web 100. The longitudinal axis of the pipe 30 is situated within a plane which extends parallel to the plane of the paper web.

FIGS. 5 to 7 show only the lower web guiding element 30 with its mounting devices 06 and the assigned actuating elements 08.

The two end regions of the web guiding element 30 are each connected via screws to a bracket 33, which is in turn connected via screws to a finger 32. In place of a screw connection, any other suitable connection method is also possible. It is also conceivable for the bracket 33 and finger 32 and/or bracket 33 and web guiding element 30 to be embodied as a single piece.

Figure 8:
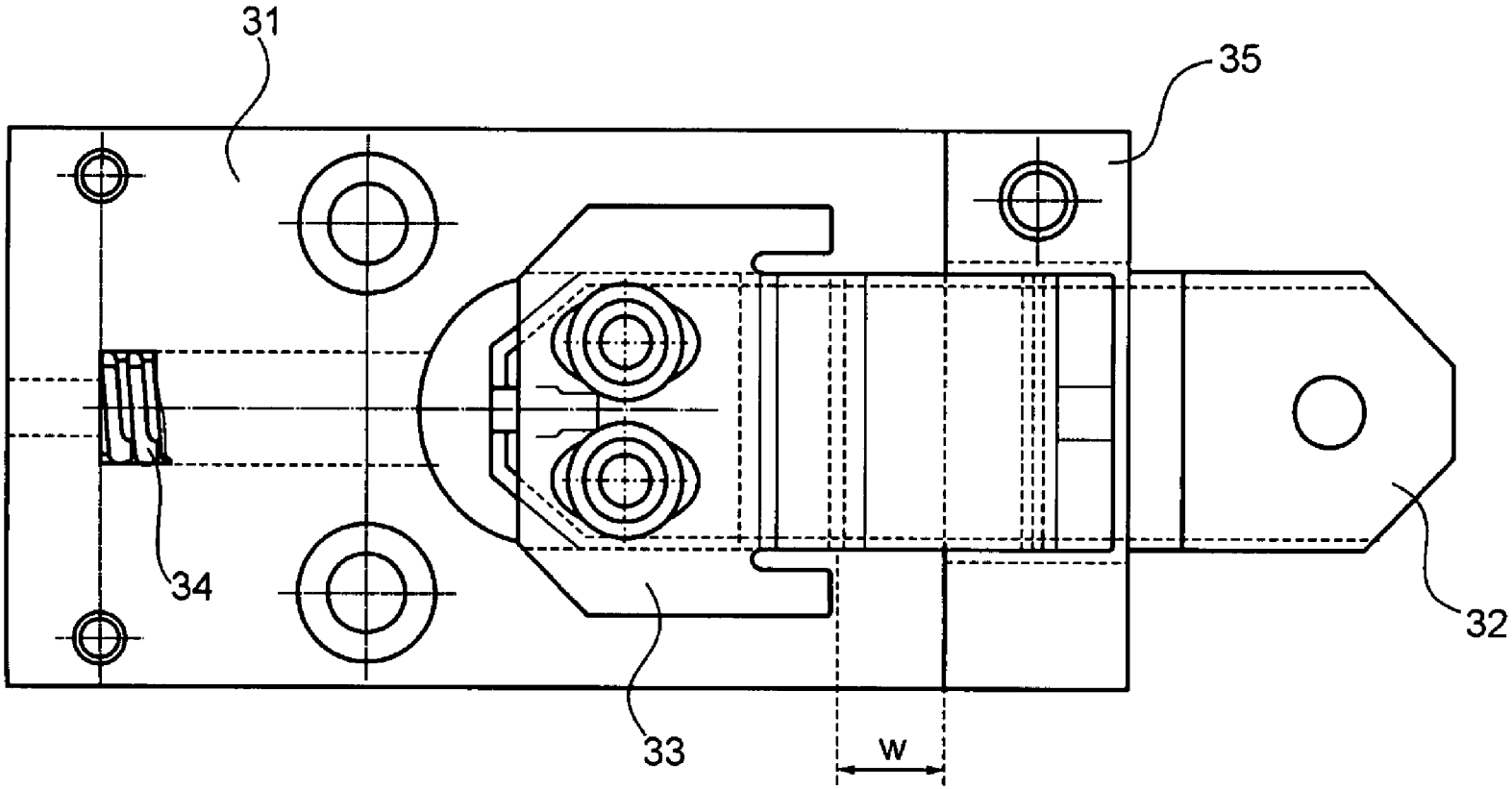
FIG. 8 a side view of the mounting device of FIG. 6.

The mounting device 06; 07 has a housing 31, in which the finger 32 is displaceably disposed. In FIG. 8, the range of motion of finger 32 and bracket 33, and therefore also the range of motion of the web guiding element 30, is indicated by the notation "path" w.

As is particularly clear from FIG. 6, an adjustment means 34, particularly a spring 34, is arranged in the housing 31 of the mounting device 06; 07, and exerts a force toward the right according to FIG. 6 on the finger 32 and on the bracket 33, and therefore also on the web guiding element 30. When the printing unit 01 is opened, this spring 34 forces the web guiding element 30 from its first position shown in FIGS. 1 and 3 to its second position shown in FIGS. 2 and 4, in which position the web guiding element lifts the paper web 100 off of the blanket cylinders 20 of the printing couples of the printing unit 01, or increases the distance between paper web 100 and blanket cylinders 20. The movement of the web guiding element 30 into its second position is completed when the finger 32 or the bracket 33 strikes a boundary of the housing 31 of the mounting device 06, 07 or some other boundary element.

The locking element 35, which is connected via screws or some other type of connection to the interior side of the housing 31 of the mounting device 06; 07, which side faces the web guiding element 30, guides and/or secures the finger 32 in the housing 31 of the mounting device 06; 07.

The printing unit 01 has at least one mounting device 06; 07, on or in which the spring 34 and/or the bracket 33 and/or the finger 32 can be arranged.

FIG. 7 shows a plan view of the configuration of FIG. 6.

FIGS. 5 to 7 further show the actuating element 08 (09), which is connected via screws or some other type of connection to the movable frame part 03, preferably to the side frame walls thereof. When the movable frame part 03 is moved from the position shown in FIG. 2 or 4 toward the stationary frame part 02 in order to close the printing unit 01, the actuating element 08; 09 forces the finger 32 toward the left according to FIG. 6 or 7, thereby moving the web guiding element 30 back to its initial position, in which it is no longer in contact with the paper web 100, or at least will not create a distance or an increase in the spacing between the paper web 100 and the blanket cylinder or cylinders 20.

As a result of the force of the spring 34, the web guiding element 30 is automatically moved from its first position to its second position when the printing unit 01 is opened. Finger 32, bracket 33 and web guiding element 30 are therefore moved by the force of the spring 34 as soon as the printing unit 01 is opened.

When the printing unit 01 is closed, the actuating element 08; 09 forces the finger 32, the bracket 33 and therefore also the web guiding element 30 against the force of the spring 34 back to the first position of the web guiding element 30.

It is conceivable for a drive unit, for example, an electric motor, to be used in place of spring 34 to move the web guiding element 30. Other possible drives, such as a pneumatic or a hydraulic drive or a combination of such a drive with a spring, are also conceivable. In such cases, it would be possible to determine, using a sensor 60 or some other type of detecting unit, that the printing unit 01 is being opened or is open, and as a result to automatically activate the at least one drive unit by means of a control unit 62, as seen in FIG. 2, causing said drive unit to move the web guiding element or elements 30 into the second position. For example, the web could always be moved away automatically when the status "washing the transfer cylinder" is activated.

The at least one web guiding element 30 can be embodied as a web guiding element 30 that is routinely provided in a printing unit 01, or as an additionally provided component of the printing unit 01.

In place of an automatic or self-actuated movement of the web guiding element or elements 30, the desired displacement of the web guiding element or elements 30 can also be initiated according to the invention by an operator of the printing unit 01. This can be accomplished, for example, by actuating an actuating element disposed on the printing press or on a remote control unit.

The web guiding element 30 located in the printing unit 01 can be a web guiding roller.

Figure 10:
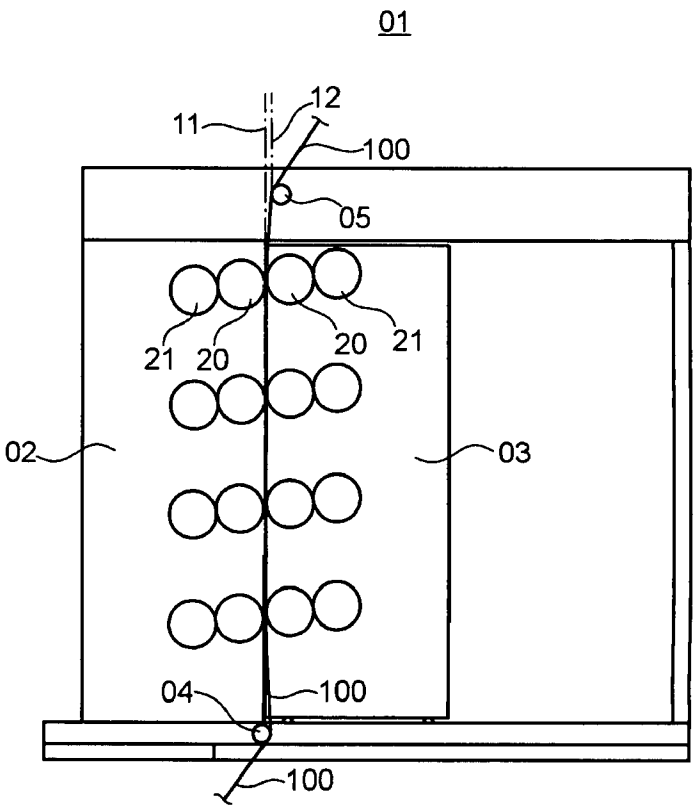
FIG. 10 a schematic illustration of the additional embodiment example of the printing unit according to FIG. 9, with the printing unit in the closed position.
Figure 9:
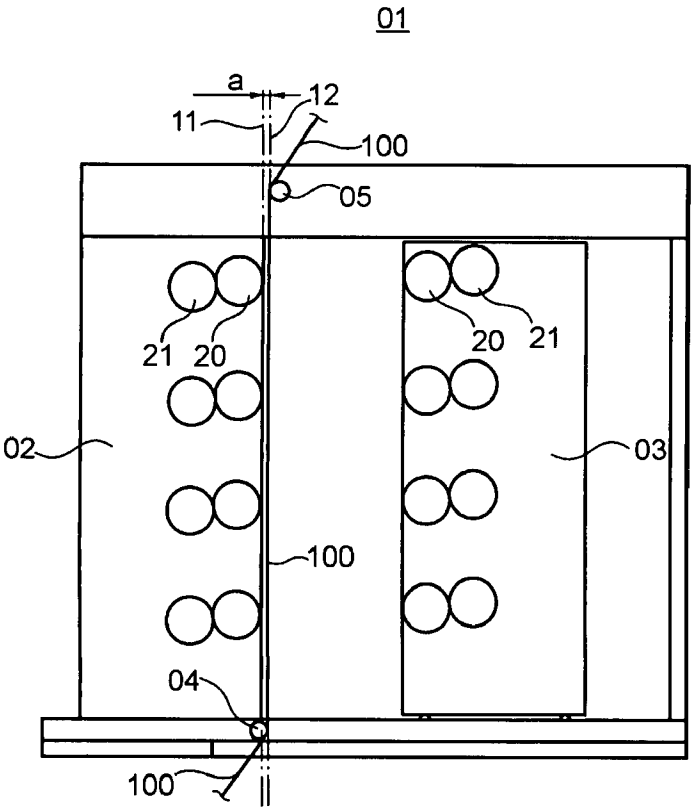
FIG. 9 a schematic illustration of a further embodiment example of a printing unit comprising one stationary frame part and one movable frame part, with the printing unit in the open position.

As is shown in FIGS. 9 and 10, a tangent 11 is established by the transfer cylinders 20 of the stationary frame part 02, wherein another tangent 12 is established by the at least two web guiding elements 30; 04; 05. The tangent 11 of the transfer cylinders and the tangent of the web guiding elements 30; 04; 05 are arranged at a distance a from one another (FIG. 9). When the printing unit 01 is open, the tangent 11 defines the path of the material web 100 between the web guiding elements 30; 04; 05. When the printing unit 01 is closed (FIG. 10), the tangent 12 of the transfer cylinders 20 defines the path of the material web 100 between an uppermost transfer cylinder and a lowermost transfer cylinder 20.

When the printing unit 01 is closed, the material web 100 rests against the transfer cylinders 20 of both frame parts 02; 03.

Each frame part 02; 03 preferably has four transfer cylinders 20 and four forme cylinders 21.

When the printing unit 01 is open, the material web 100 is spaced from the transfer cylinders 20 of both frame parts 02; 03, i.e., the distance a between the material web 100 and at least the transfer cylinders 20 of a stationary frame part 02 is modified. While the printing unit is open, at least one transfer cylinder 20 is rotating, for example, and at least one transfer cylinder 20 is preferably cleaned. Preferably, all transfer cylinders 20 of at least the stationary frame part 02 are cleaned.

While the at least one transfer cylinder 20 is rotating, an associated forme cylinder 21 is preferably rotating or held at another circumferential speed.

While a preferred embodiment of a printing unit of a printing press and a method for using a printing unit, in accordance with the present invention, have been set forth fully and completely hereinabove, it will be apparent to one of skill in the art that various changes could be made without departing from the true spirit and scope of the present invention which is accordingly to be limited only by the appended claims.

What is claimed is:

1. A printing unit of a printing press comprising:

a first, stationary frame part and a secondary, movable frame part, a relative spacing distance between which first, stationary frame part and which second, movable frame part can be modified, and wherein, when the printing unit is in a closed position, the first and second frame parts are spaced at a first distance from one another and wherein, when the printing unit is in an open position, the first and second frame parts are spaced at a second distance from one another, the first distance being less than the second distance;

a plurality of first form cylinders and cooperating first transfer cylinders in the first frame part;

a plurality of second form cylinders and cooperating second transfer cylinders in the second frame part, the first transfer cylinders and the second transfer cylinders cooperating to imprint a material web when the first frame part and the second frame part are in the closed position;

a material web infeed area of the printing unit and a material web outfeed area of the printing unit;

at least first and second web guiding elements in the printing unit, at least a first one of the two at least first and second web guiding elements being positioned in the infeed area of the printing unit and at least a second one of the at least first and second web guiding elements being positioned in the outfeed area of the printing unit;

a first vertically extending tangent established by the first plurality of transfer cylinders of the first, stationary frame pad wherein, when the printing unit is in the closed position, the first tangent of the plurality of first transfer cylinders defines a path of travel of the material web between an uppermost one of the plurality of first transfer cylinders and a lowermost one of the plurality of first transfer cylinders in the first, stationary frame part; and a second vertically extending tangent established by the at least two first and second web guiding elements, the first tangent of the transfer cylinders and the second tangent of the web guiding elements being arranged at a distance from one another when the printing unit is in the open position.

2. The printing unit according to claim 1 wherein, when the printing unit is open, the second tangent of the at least two web guiding elements defines the path of the material web between the at least two web guiding elements.

3. The printing unit according to claim 1 further including at least one third web guiding element and wherein, when the printing unit is in the closed position, the at least one third web guiding element is located in a first position, and when the printing unit is in the open position, the at least one third web guiding element is located in a second position, different from the first position.

4. The printing unit according to claim 3 wherein, when the printing unit is in the open position, the at least one third web guiding element moves to the second position one of automatically and in response to an action by a press operator.

5. The printing unit according to claim 3 wherein the at least one third web guiding element, in its second position deflects the material web such that the distance between the material web and the at least one transfer cylinder is one of created and increased.

6. The printing unit according to claim 3 wherein the at least one third web guiding element is positioned between the infeed area and the outfeed area of the printing unit.

7. The printing unit according to claim 6, characterized in that at least two transfer cylinders are provided, arranged one above the other, between the first web guiding element positioned in the infeed area of the printing unit and the second web guiding element positioned in the outfeed area of the printing unit.

8. The printing unit according to claim 7, characterized in that the first and second web guiding elements position the material web at the distance from the at least two transfer cylinders simultaneously.

9. The printing unit according to claim 3, characterized in that the al least one third web guiding element is arranged on the first stationary frame part.

10. The printing unit according to claim 3, characterized in that the at least one third web guiding element is arranged on one of the first and second frame parts and in that at least one actuating element is arranged on the other of the first and second frame parts, which actuating element acts upon the at least one of the third web guiding elements or upon a component that is connected to the at feast one of the third web guiding elements in such a way that as the printing unit is moved to the closed position, the at least one of the third web guiding is moved from its second position to its first position.

11. The printing unit according to claim 3, characterized in that the at least one web third guiding element is a pipe having a length which is one of equal to and greater than a width of the material web to be imprinted.

12. The printing unit according to claim 3, characterized in that the printing unit has at feast one of at least one spring and at least one drive means, which exerts a force on one of the at least one third web guiding element and on a component that is connected to the web guiding element, to thereby move the at least one third web guiding element from its first position to its second position.

13. The printing unit according to claim 1, characterized in that each of the at least first and second web guiding elements located in the printing unit is a web guiding roller.

14. The printing unit according to claim 10, characterized in that the printing unit utilizes a control system, wherein the control system is embodied such that during a process of washing the at least one of the transfer cylinders, the control system shifts the at least one third web guiding element from the first position to the second position.

15. The printing unit according to claim 3 wherein the printing unit has at feast one sensor which is capable of determining at least one of whether the printing unit is in its open position and is being moved to its open position, and further wherein the printing unit utilizes a control system; which is connected to the at least one sensor for the purpose of data transmission, the control system being embodied so that it causes the at least one third web guiding element to shift from the first position to the second position when the sensor determines that the printing unit is one of in its open position and is being moved to its open position.

16. The printing unit according to claim 3, characterized in that the at least one third web guiding element is embodied such that when the at least one third web guiding element is in its second position, the distance between the material web and the at least one cylinder has a prescribed value.

17. The printing unit according to claim 3, characterized in that when the at least one third web guiding element is in its second position, the distance between the material web and the first transfer cylinders is at least 5 mm.

18. The printing unit according to claim 1, characterized in that each frame part of the printing unit comprises at least four of the transfer cylinders and at least four of the form cylinders.

* * * * *

UNITED STATES PATENT AND TRADEMARK OFFICE

CERTIFICATE OF CORRECTION

PATENT NO. : 8,127,671 B2
APPLICATION NO. : 12/737722
DATED : March 6, 2012
INVENTOR(S) : Christoph Alfons Schmitt It is certified that error appears in the above-identified patent and that said Letters Patent is hereby corrected as shown below:

Column 7, Claim 1, line 24, after “first”, change “form” to --forme--;

Line 26, after “second”, change “form” to --forme--; and

Line 35, after “the”, delete “two”.

Column 8, Claim 9, line 22, after “the”, change “al” to --at--.

Claim 10, line 30, after “at”, change “feast” to --least--; and

Line 33, after “guiding”, insert --elements--.

Claim 12, line 39, before “one”, change “feast” to --least--.

Claim 14, line 50, after “at”, insert --,--.

Claim 15, line 55, after “at”, change “feast” to --least--; and

Line 58, after “system”, delete the “;”.

Column 10, Claim 18, line 3, after “the” (second occurrence), change “form” to --forme--.

Signed and Sealed this
Twenty-sixth Day of June, 2012

David J. Kappos

David J. Kappos
*Director of the United States Patent and Trademark Office*